United States Patent [19]

Hendriks et al.

[11] Patent Number: 4,597,242

[45] Date of Patent: Jul. 1, 1986

[54] PROCESS AND APPARATUS FOR THE ASEPTIC PACKAGING OF PRODUCTS SUCH AS FOODSTUFFS AND PHARMACEUTICAL PRODUCTS

[75] Inventors: Albertus G. Hendriks, Vlaardingen, Netherlands; Aart Mijnders, Buggenhout, Belgium

[73] Assignee: Lever Brothers Company, New York, N.Y.

[21] Appl. No.: 500,050

[22] Filed: Jun. 1, 1983

[30] Foreign Application Priority Data

Jun. 1, 1982 [NL] Netherlands ..... 8202209

[51] Int. Cl.[4] ..... B65B 55/10

[52] U.S. Cl. ..... 53/426; 53/453; 53/167

[58] Field of Search ..... 53/110, 167, 425, 426, 53/453; 422/38, 302, 304

[56] References Cited

U.S. PATENT DOCUMENTS

| | | | |
|---|---|---|---|
| 3,086,336 | 4/1963 | Rausing | 53/167 |
| 3,530,641 | 9/1970 | Bergstrom | 53/167 |
| 3,564,812 | 2/1971 | Mueller | 53/426 |
| 3,566,575 | 3/1971 | Liesiecki | 53/426 |
| 3,911,640 | 10/1975 | Rausing | 53/110 X |
| 3,972,153 | 8/1976 | Kiellarson | 53/426 |
| 4,035,981 | 7/1977 | Braun | 53/426 |
| 4,055,035 | 10/1977 | Sjostrand | 53/167 |

*Primary Examiner*—John Sipos

*Attorney, Agent, or Firm*—James J. Farrell; Milton L. Honig

[57] ABSTRACT

The invention relates to a process and an apparatus for the aseptic packaging of products such as foodstuffs and pharmaceutical products, using a tunnel over the filling track of the filling machine, which tunnel is provided with means for introducing sterile gas. This aseptic packaging could be improved by introducing the sterile gas only from one side, preferably such that the gas stream moves contrary to the product stream, and by providing means which ensure a horizontal gas flow of low turbulance in the tunnel so that the suction of ambient air into the system is avoided.

16 Claims, 1 Drawing Figure

PRINCIPLE OF AN EFFECTIVE PROTECTIVE TUNNEL FOR F.F.S. MACHINES

Figure 1:
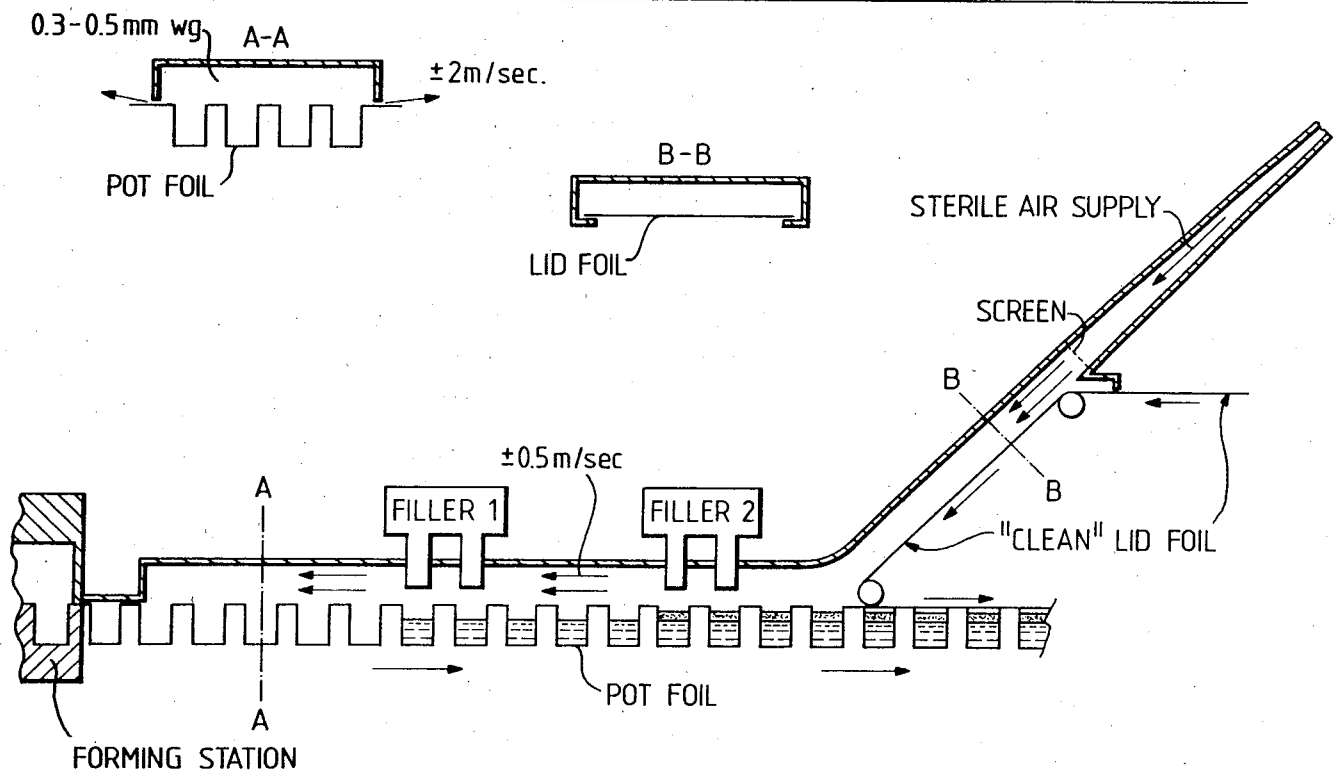

PROCESS AND APPARATUS FOR THE ASEPTIC PACKAGING OF PRODUCTS SUCH AS FOODSTUFFS AND PHARMACEUTICAL PRODUCTS

The invention relates to a process and apparatus for the aseptic packaging of products such as foodstuffs and pharmaceutical products, using a tunnel over the filling track of the filling machine, which tunnel is provided with means for introducing a gas that is as sterile as possible.

Such a process is used in many factories for the packaging of, for example, dairy produce. Suitable apparatuses for this purpose are commercially available. Examples are certain filling machines that are known under the trade names of BENHIL, ERCA and HAMBA. It has appeared in practice that the working of these known apparatuses is often insufficiently aseptical. There is therefore need of an apparatus and process with which the packaging of products such as foodstuffs and pharmaceutical products can be carried out more aseptically.

The invention provides a process for the aseptic packaging of products such as foodstuffs and pharmaceutical products, using a tunnel over the filling track of the filling machine, said tunnel being provided with a gas that is as sterile as possible, which is characterized in that only from one side a gas flow which is as sterile as possible is introduced at such a pressure and velocity as to cause a slight overpressure in the tunnel, which counteracts the suction of ambient air into the system, and in which the excess of introduced air escapes through the crevices present, and the gas to be introduced is guided in such a way as to cause a horizontal flow of low turbulence in the tunnel. This can be achieved for example by passing the gas flow before its entry into the tunnel through one or more perforated plates, which are placed transversely to the direction of the gas flow, and/or gas filters. It is desirable that the transition from the gas supply unit to the tunnel should be made as smooth as possible by avoiding acute-angled edges, so as to minimise any disturbance in the degree of laminarity of the gas flow. It is further preferred to introduce the gas flow countercurrently to the flow of products.

In a suitable embodiment the supply of the gas flow immediately before the tunnel is formed by a semi-oval or rectangular tube, the moving bottom of which is formed by a film from which the upper sides of the product-filled containers in the tunnel are formed.

The film is preferably rendered poor in germs and optionally sterilized before it is introduced as moving bottom of the gas supply unit. More or less similar methods are described in Netherlands patent application No. 73 11 033 (=U.S. Pat. No. 3 911 640) and French patent specification No. 1 597 237.

Furthermore it is preferable to adjust the dimensions of the tunnel and the velocity of the gas flow to each other in such a way that the gas velocity in the tunnel is from 0.5–1.0 m/s, preferably 0.3–0.5 m/s. Finally the overpressure in the tunnel is preferably adjusted in such a way that the gas escaping through the crevices has a velocity of 0.1–10 m/s, preferably 1–3 m/s.

A particular embodiment is formed by a process in which on the spot and immediately before filling the containers are formed from a film, which film with containers formed therein constitutes the moving bottom of the tunnel. It is then desirable to ensure that on using containers formed on the spot there is a wide transition between the forming station and the tunnel in order to avoid pressure fluctuations during the transport of the containers. In particular the wide transition in the direction of the transport has a length which exceeds the diameter of the opening of the container.

Although, of course, the gas flow used may consist of inert, in particular bacteriostatic gases such as nitrogen or carbon dioxide, sterilized air can successfully be used as gas flow. Since the latter is mostly cheaper, it is of course preferred. In order to ensure as much as possible that the gas flow in the tunnel retains a laminar character, it is desirable that the filling machines issuing in the tunnel should be of such a construction as to minimise any disturbance of the gas flow pattern in the tunnel. This implies that the filling machines must be placed almost entirely outside the tunnel and that only a few small pipes with a minimum of movable parts are placed in the tunnel.

The characterizing parts indicated in the preceding two paragraphs, which are used preferably, are known per se from French patent specification No. 1 597 237.

The invention further provides an apparatus for the aseptic packaging of products such as foodstuffs and pharmaceutical products, comprising a tunnel over the filling track of the filling machine, which tunnel is provided with means for introducing a gas that is as sterile as possible, characterized in that the gas supply unit is placed on only one side of the apparatus and is connected to the tunnel in such a way that during operation of the apparatus the gas flow coming from the gas supply unit gradually changes direction and the laminar flow character of the gas flow created in the gas supply unit is retained as much as possible in the tunnel. This can be achieved, inter alia, by constructing the gas supply unit close to the tunnel as a semi-oval or rectangular tube, the topside of which merges into the topside of the tunnel with a rounded and obtuse use angle (i.e. between 90° and 180°), preferably between 120° and 160°. The desired height of the tunnel is dependent on the amount of gas escaping through the crevices, the desired gas velocity in the tunnel and the width of the tunnel. Preferably the gas supply unit is placed near the outlet of the product flow, so that on operation of the apparatus a gas flow is caused in a direction that is opposite to the direction of the flow of products. The laminar flow can be provided by a gas supply unit comprising one or more perforated plates placed transversely to the direction of flow of the gas, and/or gas filters. These plates or gas filters form a barrier which effects a gas flow of low turbulence.

In a practical embodiment, during operation of the apparatus according to the invention, the moving bottom of the gas supply unit close to the tunnel is formed by a film which is used for closing the containers filled with product, said film leaving only very narrow crevices between the film and the gas supply unit.

In a suitable embodiment the tunnel consists of a semioval or rectangular tube, the bottom of which is formed by a conveyor belt in or on which the, preferably presterilised, containers can be placed which are to be filled in the tunnel with the product to be packaged and whereby the distance from the conveyor belt and/or the upper edges of the containers to the lower edge of the sides of the tunnel should be so small that only crevices with a width of 0.1–5 mm, preferably 0.5–3 mm are formed.

A particularly suitable embodiment, however, is an apparatus provided with a forming station, in which the containers can be formed immediately before the moment when they are brought into the filling machine comprising a tunnel and in which the moving bottom of the tunnel is constituted by a film with containers formed therein. In that case it is desirable that the apparatus should comprise a wide transition area between the forming station and the tunnel, with a length of said area in the direction of transport that exceeds the diameter of the opening of the containers to be formed in the forming station. Finally it is preferable for the apparatus according to the invention to be provided with such filling machines that the movable or fixed parts of the filling machines placed in the tunnel have the smallest possible volume, so as to minimise, when in use, any disturbance of the gas flow in the tunnel. In this connection we speak of filling machines, because a single as well as a plurality of filling machines can be used. A plurality of filling machines is required if either several containers side by side are filled simultaneously, or one container has to be filled with several layers of different products. (cf. the French patent specification 1 N. 597 237 mentioned before).

The invention will be illustrated with reference to FIG. 1, in which the principle of an effectively protected tunnel for so-called form-fill-seal machines is shown. In this FIGURE, at left, part of the forming station can be seen in which the containers are formed from a film.

This film, having as recesses the so formed tubs, is moved along in the direction indicated by the arrows located beneath the pot foil in FIG. 1, after which different layers of products are filled into the containers by the filling machines 1 and 2. In the right-hand part a substantially sterilized lid-film comes from above right and is placed on the filled containers, followed by sealing said lid-film to the containers. The sealing station required for this operation is not shown in the FIGURE. The tunnel begins immediately beside the forming station; said tunnel however first has a lowered transitional area which ensures that the air flow, which in the drawing passes from right to left over the containers, indicated by double arrows, can hardly escape at the transitional area, so that hardly any or only very slight fluctuations in pressure occur during the entry of the containers into the tunnel. At AA a cross-section is indicated at the top of the FIGURE, from which it appears that in the embodiment shown in the FIGURE each time four containers have been formed side by side in the film. The gas flow leaves the tunnel through the crevices at a velocity of about 2 m/s. The overpressure required for this at point AA in the given embodiment was about 0.3–0.5 mm water pressure. The velocity in the tunnel of the gas flow, in this case sterilised air, between the filling machines was about 0.5 m/s. In the drawing at right the gas supply unit can be seen, into which sterilised air is blown by means of a blower, said air being subsequently led through a perforated plate and/or a gas filter in order to render the air flow as laminar as possible—indicated in the drawing by a double arrow—, after which the bottom of the gas supply unit is formed by the moving lid-film, which optionally has been previously sterilised but in any case rendered poor in germs. As can be seen in the FIGURE, the gas supply unit lies at an obtuse angle of 135° to the tunnel. Furthermore, the angle has been rounded as much as possible so as to allow the air flow to change direction gradually and thus minimise the formation of vortexes. These vortexes may cause local areas of underpressure, with the result that at the crevices formed between the tunnel and the moving film bottom non-sterile outside air can be drawn into the system. To prevent this, it is desirable to maintain a gas flow of low turbulence.

Finally, at BB a cross-section is shown of the part of the gas supply unit close to the tunnel, which crosssection is indicated in the middle top part of the FIGURE. Here too, it can be seen that there are narrow crevices between the lid-film and the edges of the gas supply unit, as a result of which only a minimum amount of gas can escape. The apparatus according to the invention has a number of advantages over the tunnels supplied until now by manufacturers of filling machines. In conventional tunnels often multiple air inlets are applied (cf. French patent specification No. 1 597 237), or the air inlet is placed in the center, so that the gas can stream in several directions (cf. Netherlands patent application No. 73 11 033). These known solutions, however, often result in the formation of areas of underpressure and/or vortexes, in consequence of which non-sterile outside air, and thus infections, are draw in through the crevices of the encasing. As according to the invention the gas flow is introduced from only one side, it is better feasible in practice to maintain a maximum degree of laminarity in the gas flow and as result the number of vortexes occurring in the system is highly restricted. Another difference is the sharp transition, which is often found between the lid-film box and the tunnel, again resulting in vortexes. Also this drawback is avoided by the special connection of the gas supply unit in the tunnel. Finally, the wide transition known per se, applied in a preferred embodiment according to the invention is an additional measure which strongly reduces pressure variations in the tunnel.

As compared to a so-called "clean room" or a box with laminar flow, a tunnel has the great practical advantage that the machine can be placed in a production room, without the need of special arrangements. The amount of "sterile air" required for the process according to the invention, which is mostly obtained by filtration, is very small (about 300 $m^3/h$) as compared to, for example, the amount required for a box with laminar flow (about 6000 $m^3/h$), so that the required cost of energy is very low. The invention can most favourably be applied with so-called form-fill-seal machines, because in that case the risk of leakages is very small. If one wants to apply an apparatus according to the invention for a filling machine for preformed tubs, additional measures will have to be taken, because the risk of a non-placed tub leaving an open hole in the conveyor belt is greater, and thus the tunnel can more readily be infected.

We claim:

1. A process for the aseptic packaging of products such as foodstuffs and pharmaceutical products, comprising moving a film web having containers formed therein along a filling track having a longitudinal axis, filling said containers along said track and closing said containers at the end of said track, said track have thereover a tunnel parallel to said longitudinal axis, said tunnel being provided with a single gas flow from a gas supply unit that is as sterile as possible, characterized by introducing said sterile gas so as to flow parallel to said longitudinal axis and only from one longitudinal end at such a pressure and velocity as to cause a slight overpressure in the tunnel, which counteracts the suction of ambient air into the system, and in which the excess of introduced gas escapes through the crevices present, and guiding said gas substantially parallel to said longitudinal axis to cause a flow of low turbulence in the tunnel.

2. A process according to claim 1, characterized in that the gas flow before its entry into the tunnel is passed through one or more gas filters or perforated plates placed transversely to the direction of the gas flow.

3. A process according to claim 1 characterized in that the transition from the gas supply unit to the tunnel is made as smooth as possible so as to minimize any disturbance in the degree of laminarity of the gas flow.

4. A process according to claim 1, characterized in that the gas flow is introduced into the tunnel countercurrently to the direction of movement of the film web having containers formed therein.

5. A process according to claim 4, characterized in that the supply of the gas flow immediately before the tunnel is formed by a semi-oval or rectangular tube, the moving bottom of which is formed by a film from which the upper sides of the containers filled with product in the tunnel are formed.

6. A process according to claim 1, characterized in that the dimensions of the tunnel and the velocity of the gas flow are adjusted to each other in such a way that the gas velocity in the tunnel is from 0.5–1.0 m/s.

7. A process according to claim 1, characterized in that the overpressure in the tunnel is adjusted in such a way that the gas escaping through the crevices has a velocity of 0.1–10 m/s.

8. An apparatus for the aseptic packaging of products such as foodstuffs and pharmaceutical products, comprising means for providing containers, filling track means for transporting said containers in a longitudinal direction through said apparatus, filling machine means for filling said containers, means for providing a closure for said containers, means for closing said containers, and a tunnel over said filling track extending in said longitudinal direction, which tunnel is provided with a single gas supply unit for introducing a laminar gas flow that is as sterile as possible and mounted at only one longitudinal end of said tunnel to provide a gas flow parallel to said longitudinal directiona, and means for connecting said gas supply to said tunnel so that during operation of the apparatus the gas flow coming from said gas supply unit gradually changes direction and said laminar flow character of said gas flow created in said gas supply unit is retained as much as possible to thereby maintain low turbulence in said tunnel.

9. An apparatus according to claim 8, characterized in that the gas supply unit comprises one or more gas filters or perforated plates, placed transversely to the direction of flow of the gas.

10. An apparatus according to claim 8, characterized in that the gas supply unit close to the tunnel consists of a semi-oval or rectangular tube, the top of which merges into the top of the tunnel with a rounded or obtuse angle (i.e. between 90° and 180°).

11. An apparatus according to claim 8, characterized in that the gas supply unit is placed near the end of the filling track, so that on operation of the apparatus a gas flow is caused in a direction that is opposite to the direction of transportation of the containers.

12. An apparatus according to claim 8 wherein said gas supply unit comprises a moving bottom formed by a film used for closing said containers filled in said tunnel.

13. An apparatus according to claim 8, characterized in that the tunnel comprises a semi-oval tube, wherein the bottom of said tunnel is a conveyor belt having containers thereon and wherein the distance from the upper edges of the containers to the lower edges of the sides of said tunnel comprise crevices with a width of 0.1–5 mm.

14. An apparatus according to claim 13 wherein said tunnel comprises a rectangular tube.

15. An apparatus according to claim 13 wherein said crevices have a width of 0.5–3 mm.

16. An apparatus according to claim 14 wherein said crevices have a width of 0.5–3 mm.

* * * * *